US007850299B2

(12) United States Patent
Hiroki et al.

(10) Patent No.: US 7,850,299 B2
(45) Date of Patent: Dec. 14, 2010

(54) IMAGE FORMING APPARATUS

(75) Inventors: Masashi Hiroki, Yokohama (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 875 days.

(21) Appl. No.: 11/619,715

(22) Filed: Jan. 4, 2007

(65) Prior Publication Data

US 2008/0165238 A1 Jul. 10, 2008

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS

2006/0268049 A1* 11/2006 Jung et al. ..... 347/29
2008/0165215 A1 7/2008 Hiroki et al.
2008/0165218 A1 7/2008 Hiroki et al.
2008/0165220 A1 7/2008 Hiroki et al.
2008/0165231 A1 7/2008 Hiroki et al.
2008/0165236 A1 7/2008 Hiroki et al.
2008/0165239 A1 7/2008 Hiroki et al.
2008/0165240 A1 7/2008 Hiroki et al.
2008/0165241 A1 7/2008 Hiroki et al.
2008/0165242 A1 7/2008 Hiroki et al.

FOREIGN PATENT DOCUMENTS

JP 04286655 A * 10/1992
JP 2005-125675 5/2005
JP 2006-225075 8/2006

* cited by examiner

*Primary Examiner*—Stephen D Meier
*Assistant Examiner*—Alexander C Witkowski
(74) *Attorney, Agent, or Firm*—Turocy & Watson, LLP

(57) ABSTRACT

An image forming apparatus includes an apparatus body, a conveying mechanism that is provided in this apparatus body and conveys a sheet, a recording head that ejects an ink to the medium conveyed by this conveying mechanism and records an image on the medium, and a sheet guide that is spaced apart from and opposed to this recording head, guides the sheet, and is provided to be freely inserted into and taken out from the apparatus body.

10 Claims, 9 Drawing Sheets

IMAGE FORMING APPARATUS

BACKGROUND OF THE INVENTION

1. Field of the Invention

The present invention relates to an image forming apparatus for printing an image on a medium such as a print sheet, and, more particularly to an image forming apparatus that has a recording head of an ink jet system.

2. Description of the Related Art

As an image forming apparatus of this type, for example, as disclosed in JP-A-2005-125675, there is known an image forming apparatus that has a sheet conveying path for conveying a sheet in an apparatus body thereof and ejects an ink from a recording head to the sheet conveyed by this sheet conveying path to form an image.

Usually, a sheet guide (a media guide) is spaced apart from and opposed to the recording head and the ink is ejected to a sheet guided along this sheet guide.

At the time of a printing operation, ink mist is generated around the recording head and, in particular, the sheet guide is stained by this ink mist. When the sheet guide is stained by the ink mist, it is likely that, when following sheets are guided, the sheets are stained.

Thus, conventionally, the sheet guide is cleaned periodically.

However, conventionally, since the sheet guide is fixedly provided in the apparatus body, in cleaning the sheet guide, it is necessary to insert a cleaning tool into the apparatus body and perform work in a small space. Therefore, there is a problem in that workability is low and it is difficult to check a cleaning effect.

As other means for cleaning the sheet guide, paper (e.g., white paper) for cleaning is passed through the sheet guide to clean the stain of the sheet guide with this paper.

However, in this case, there is a problem in that this is uneconomical because paper is used wastefully.

BRIEF SUMMARY OF THE INVENTION

An aspect of the invention has been devised in view of such a point and it is an object of the invention to provide an image forming apparatus that makes it possible to take out a media guide to the outside of an apparatus body and clean the media guide.

An image forming apparatus according to the aspect of the invention includes an apparatus body, a conveying device that is provided in this apparatus body and conveys a medium, a recording device that ejects an ink to a medium conveyed by this conveying device and records an image on the medium, and a media guide that is spaced apart from and opposed to this recording device, guides the medium, and is provided to be freely inserted into and taken out from the apparatus body.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the invention will be hereinafter explained in detail with reference to the drawings.

Figure 1:
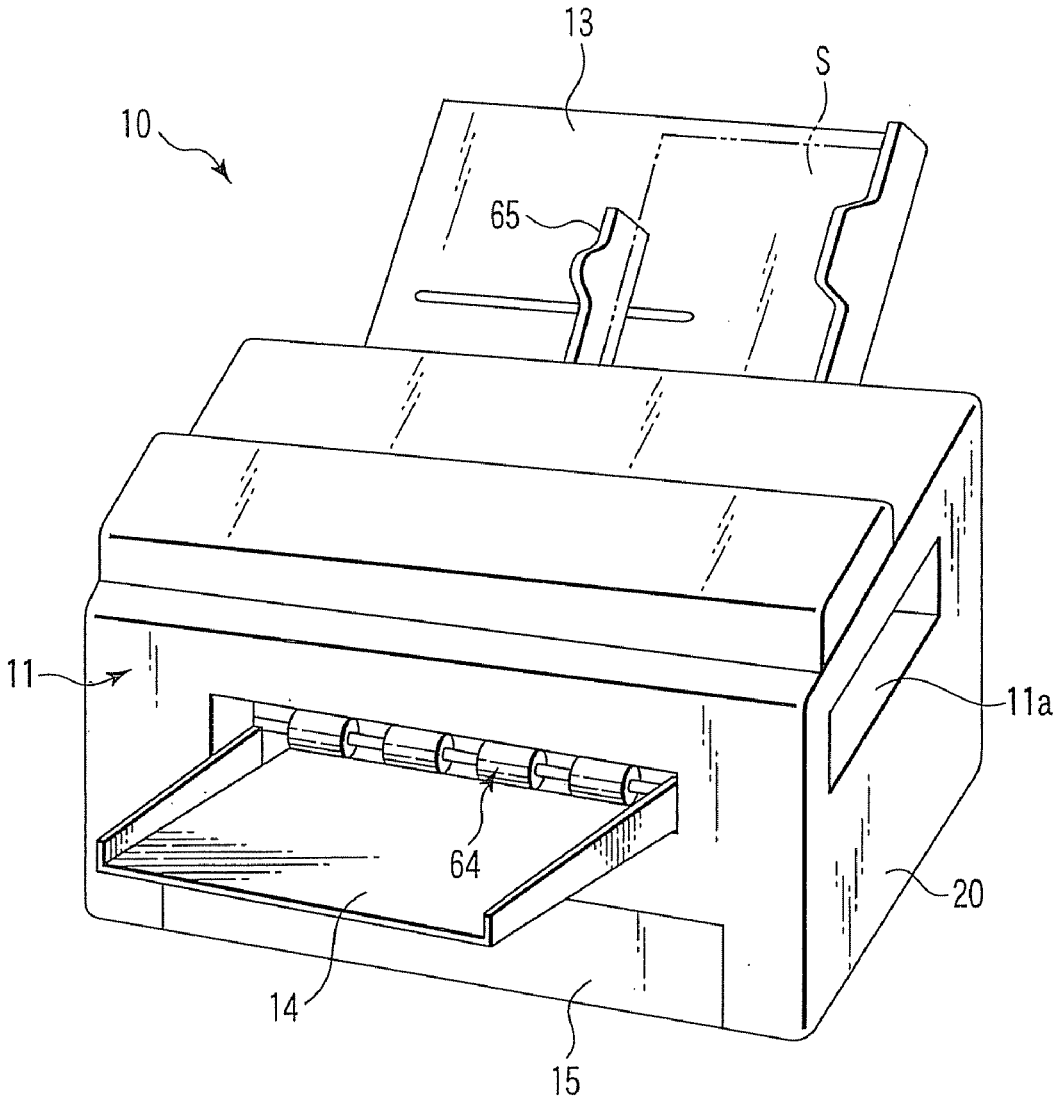
FIG. 1 is an external perspective view showing an image forming apparatus according to a first embodiment of the invention.

FIG. 1 is an external perspective view showing an image forming apparatus according to a first embodiment of the invention.

An image forming apparatus 10 includes an apparatus body 11. A first feed tray 13 is disposed on a rear side of this apparatus body 11, a discharge tray 14 is disposed on a front side of the apparatus body 11, and a second feed tray 15 is provided on a lower side of the apparatus body.

Figure 2:
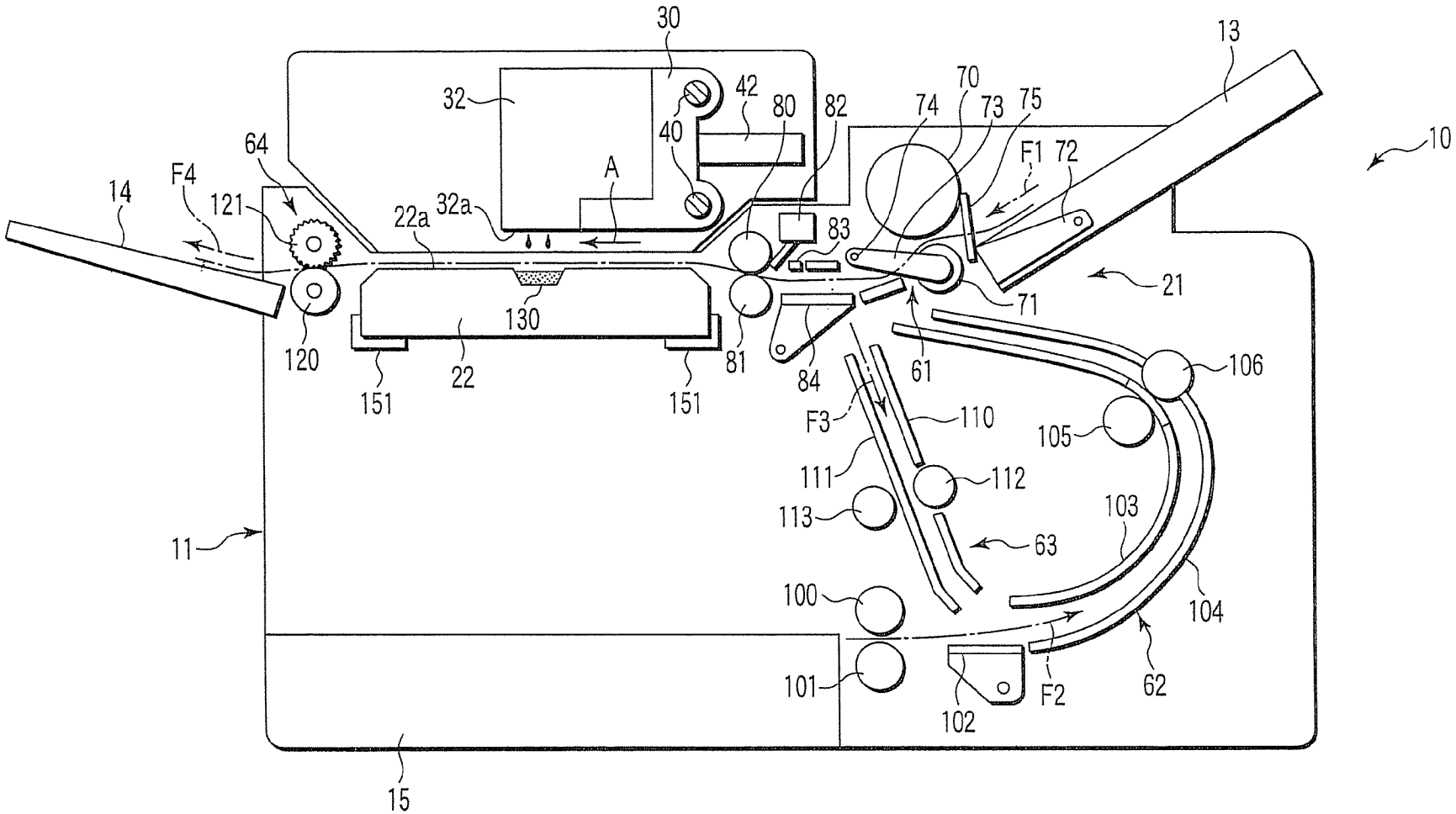
FIG. 2 is a diagram showing an internal structure of the image forming apparatus in FIG. 1.

FIG. 2 schematically shows an internal structure of the image forming apparatus 10.

Figure 3:
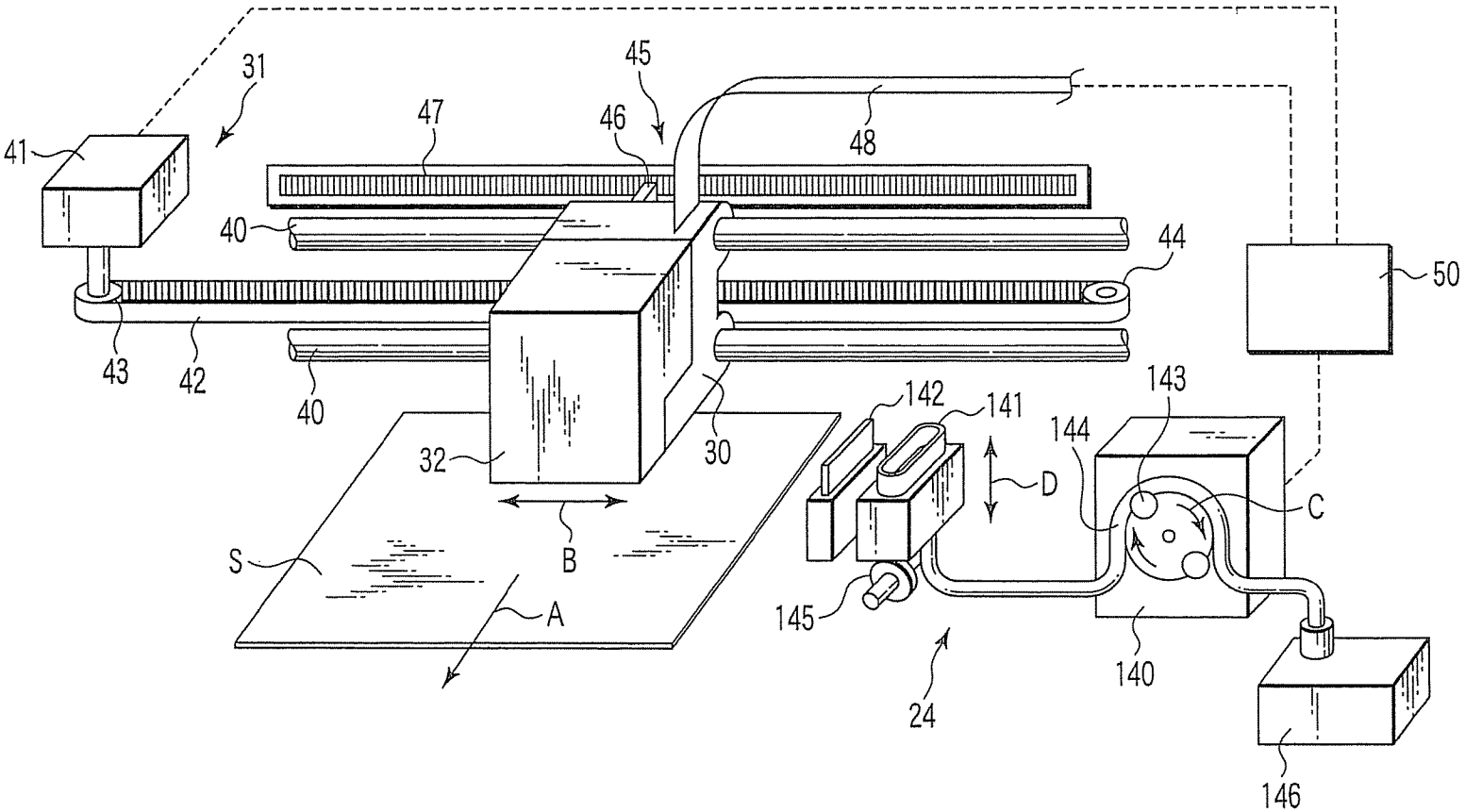
FIG. 3 is a perspective view showing a moving mechanism and a cleaning mechanism for a recording head in FIG. 2.

In the apparatus body 11, a sheet conveying mechanism 21 serving as a conveying device, a sheet guide 22 serving as a media guide that has a guide surface 22*a* in the horizontal direction, and a head cleaning mechanism 24 shown in FIG. 3 are included. The sheet guide 22 and the head cleaning mechanism 24 will be explained in detail later.

On an upper side of the sheet guide 22, a carriage 30, a carriage driving mechanism 31 for driving this carriage 30, a recording head 32 serving as a recording device of an ink-jet system mounted on the carriage 30, and the like are arranged. A replaceable ink cartridge (not shown) is housed in the recording head 32.

As shown in FIG. 2, the recording head 32 has a nozzle section 32*a* opposed to the guide surface 22*a* of the sheet guide 22 and an ink ejecting mechanism (not shown) that ejects an ink from this nozzle section 32*a*. The recording head 32 forms an image on a sheet S (shown in FIG. 3) with this ink. An arrow A in FIG. 3 indicates a conveying direction of the sheet S.

An example of the ink ejecting mechanism is a thermal type. The thermal type applies heat to the ink with a heater built in the recording head 32 to film-boil the ink. A pressure change is caused in the ink by growth or contraction of air bubbles due to this film boiling. An image is formed on the sheet S by ejecting the ink from the nozzle section 32*a* according to this pressure change. Other than the thermal type, for example, an ink ejecting mechanism that uses an element (e.g., a piezoelectric element) having a piezoelectric effect may be adopted. For example, the piezoelectric element is deformed by an electric current and an ink is ejected from a nozzle section according to a pumping action based on the deformation.

As shown in FIG. 3, the carriage driving mechanism 31 includes a carriage guide 40 extending in the horizontal direction, a motor 41 such as a stepping motor, power transmitting members such as a timing belt 42 and sprockets 43 and 44, and a sensor unit 45 for controlling a position of the carriage 30. The carriage guide 40 extends in a direction B orthogonal to the conveying direction of the sheet S. The carriage guide 40 is supported by a frame of the apparatus body 11. The recording head 32 is reciprocatingly moved in a direction (the arrow B direction) orthogonal to the conveying direction of the sheet S together with the carriage 30 along the carriage guide 40.

The rotation of the motor 41 is transmitted to the carriage 30 via the timing belt 42. Therefore, the recording head 32 reciprocatingly moves along the carriage guide 40. The sensor unit 45 for controlling a position of the carriage 30 includes, for example, an encoder sensor 46 and a ladder plate 47 serving as a section to be detected. The ladder plate 47 extends in a direction parallel to the carriage guide 40. The ladder plate 47 has a ladder pattern formed at equal pitches. The ladder pattern of the ladder plate 47 is optically detected by the encoder sensor 46 according to the position of the carriage 30, whereby the position of the carriage 30 is detected. A signal of the position detected is inputted to a control unit 50 via a flexible harness 48.

As shown in FIG. 2, the sheet conveying mechanism 21 includes a first conveying unit 61, a second conveying unit 62, a duplex-printing conveying unit 63 used in performing duplex printing, and a discharging mechanism 64.

The first conveying unit 61 conveys a sheet taken out from the first feed tray 13 to the recording head 32. The second conveying unit 62 conveys a sheet taken out from the second feed tray 15 to the recording head 32. The discharging mechanism 64 has a function of discharging a sheet having an image printed thereon onto the discharge tray 14.

It is possible to place plural sheets (e.g., print sheets) on the first feed tray 13 stacking the sheets in the thickness direction. As shown in FIG. 1, a S movable guide 65 is provided in the first feed tray 13. The movable guide 65 is movable in the width direction of the sheet S according to a size of the sheet S. It is possible to regulate a position in the width direction of the sheet S on the first feed tray 13 by moving the movable guide 65 in the width direction of the sheet S.

The first conveying unit 61 includes a feed roller 70, a separation roller 71 located below the feed roller 70, and a separation unit 72 including a separation pad. The feed roller 70 feeds a sheet taken out from the lower end of the first feed tray 13 to the recording head 32.

A torque limiter is provided in the separation roller 71. The separation roller 71 rotates in a direction identical with a direction of rotation of the feed roller 70 according to a function of the torque limiter when only one sheet is present between the separation roller 71 and the feed roller 70. When two or more sheets are present between the feed roller 70 and the separation roller 71, the separation roller 71 rotates in a direction opposite to the direction of rotation of the feed roller 70. Therefore, when plural sheets are taken out from the first feed tray 13 and fed into a space between the feed roller 70 and the separation roller 71, an uppermost sheet and the other sheets are separated and only the uppermost sheet is fed to the recording head 32. A sheet separating mechanism for taking out sheets from the first feed tray 13 one by one is constituted by the feed roller 70, the separation roller 71, the separation unit 72, and the like.

The separation roller 71 is held by a holder 73. The holder 73 is movable in the up-to-down direction around a shaft 74 extending in the horizontal direction. The separation roller 71 is brought into contact with the feed roller 70 at a predetermined load by a spring and separated from the feed roller 70 by a not-shown cam. It is possible to move the separation unit 72 in a direction toward and away from the feed roller 70 with a not-shown cam.

After the sheet is fed, the separation roller 71 and the separation unit 72 are separated from the feed roller 70, moved to standby positions, and put on standby until the next sheet feed time, respectively. A return lever 75 is rotatably arranged near the lower end of the first feed tray 13. When the sheet taken out from the first feed tray 13 is conveyed to the feed roller 70, the return lever 75 is retracted by a spring to a position where the return lever 75 does not hinder the conveyance of the sheet. This return lever 75 rotates in synchronization with the movement of the separation roller 71 and the separation unit 72 to the standby positions and feeds a remaining sheet back to the first feed tray 13.

The first conveying unit 61 includes a conveying roller 80, a pinch roller 81 opposed to this conveying roller 80, a sheet sensor 82, a media sensor 83, and a switching member 84. The conveying roller 80 feeds a sheet to a space between the sheet guide 22 and the recording head 32. The sheet sensor 82 has a sensor arm that is capable of detecting positions of the leading end and the trailing end of the sheet.

The media sensor 83 has a function of detecting a quality (e.g., paper quality) of a sheet. For example, when the surface of the sheet is made of a material having moisture-absorption characteristics, the media sensor 83 outputs a signal for increasing a quantity of ink ejected from the recording head 32 to the control unit 50. In the case of a sheet having glossiness on the surface thereof, for example, coat paper, the media sensor 83 performs control for outputting a signal for reducing a quantity of ink ejected from the recording head 32 to the control unit 50. In the case of color printing, a ratio of ejection of plural color elements may be adjusted on the basis of a signal from the media sensor 83.

Figure 4:
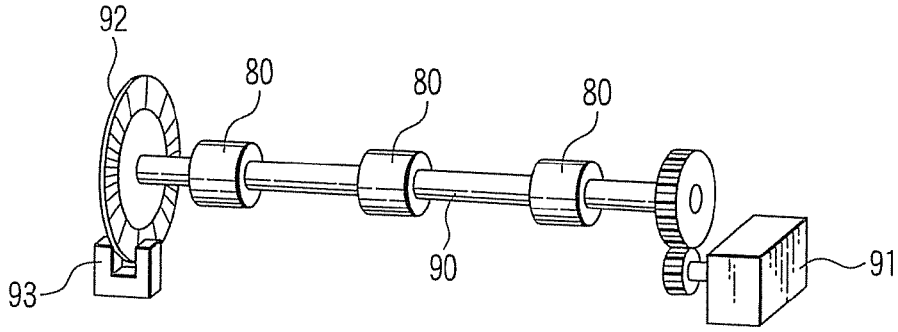
FIG. 4 is a perspective view showing a driving mechanism for a conveying roller in FIG. 2.

As shown in FIG. 4, the conveying roller 80 is attached to a shaft 90. The shaft 90 is rotated by a controllable motor 91 such as a stepping motor. The pinch roller 81 opposed to the conveying roller 80 is set in contact with the conveying roller 80 by a not-shown spring. A ladder wheel 92 of a disc shape is attached to the shaft 90 of the conveying roller 80. A ladder pattern is formed in a circumferential direction at fixed pitches in the ladder wheel 92. This ladder wheel 92 is detected by a sensor 93 and inputted to the control unit 50. Consequently, the rotation of the conveying roller 80 is controlled and conveyance of a sheet is controlled at the time of image formation.

A sheet taken out from the first feed tray 13 by the feed roller 70 is conveyed to a space between the conveying roller 80 and the pinch roller 81 through the first conveying unit 61 as indicated by an arrow F1 in FIG. 2. The leading end of the sheet is detected by the sheet sensor 82 and positioning for image formation is performed. This sheet passes between the upper surface (the guide surface 22*a*) of the sheet guide 22 and the recording head 32 according to the rotation of the conveying roller 80. When the sheet passes, an image is formed on the sheet S by the recording head 32. Ribs functioning as a conveyance reference surface are formed on the guide surface 22*a* of the sheet guide 22. These ribs keep the height of the sheet proper and prevent the sheet from heaving. The sheet having the image formed thereon is conveyed to the discharging mechanism 64.

The second conveying unit 62 includes rollers 100 and 101 for taking out a sheet from the second feed tray 15 of a cassette type, a switching member 102, guide members 103 and 104 for guiding the sheet taken out, a conveying roller 105 provided along the guide members 103 and 104, and a pinch roller 106 opposed to the conveying roller 105. The pinch roller 106 is pressed against the conveying roller 105 by a spring. It is possible to store plural sheets (e.g., print sheets) in the second feed tray 15 stacking the sheets in the thickness direction. The rollers 100 and 101 of the second conveying unit 62 function as sheet separating mechanisms for taking out sheets from the second feed tray 15 one by one.

A sheet taken out from the second feed tray 15 passes between the guide members 103 and 104 of the second conveying unit 62 through the switching member 102 as indicated by an arrow F2 in FIG. 2. This sheet is further conveyed to the conveying roller 80 by the rollers 105 and 106 and fed to the space between the recording head 32 and the sheet guide 22.

The duplex-printing conveying unit 63 includes guide members 110 and 111, a conveying roller 112 provided along the guide members 110 and 111, and a pinch roller 113 opposed to the conveying roller 112. The pinch roller 113 is pressed against the conveying roller 112 by a spring. The guide members 110 and 111 are arranged between the switching member 84 of the first conveying unit 61 and the switching member 102 of the second conveying unit 62. At the time of duplex printing, a sheet is fed in an arrow F3 direction in FIG. 2. The conveying rollers 80, 105, and 112 are obtained by providing rubber-like resin such as EPDM (ethylene propylene diene rubber) on a metal shaft and have a function of conveying the sheet S with friction.

When duplex printing is performed, after an image is printed on one side of a sheet by the recording head 32, the trailing end of this sheet is detected by the sheet sensor 82. Immediately after the detection, the conveying roller 80 rotates reversely and a position of the switching member 84 is switched. Consequently, the sheet is sent to the duplex printing conveying unit 63 as indicated by the arrow F3 in FIG. 2. Moreover, this sheet is conveyed by the rollers 112 and 113 and passes between the guide members 103 and 104 of the second conveying unit 62 through the switching member 102. In this way, the front and the back of the sheet are reversed and this sheet is sent to the recording head 32 again by the conveying roller 80, whereby an image is printed on the other side of the sheet.

The discharging mechanism 64 has a discharge roller 120, a star wheel 121, a transmitting mechanism (not shown) for transmitting the rotation of the conveying roller 80 to the discharge roller 120 and the star wheel 121, and the like. The star wheel 121 is a wheel of a gear shape made of a thin plate of stainless steel or the like. A sheet having an image printed thereon by the recording head 32 is conveyed in a direction indicated by an arrow F4 to the discharge tray 14 while being pressed against the discharge roller 120 by the star wheel 121. The sheet after printing is prevented from floating from the discharge roller 120 by this star wheel 121.

The head cleaning mechanism 24 shown in FIG. 3 includes a suction pump 140 for performing cleaning of the recording head 32, a cap 141 for preventing the recording head 32 from drying, and a blade member 142 for cleaning the nozzle section 32*a* of the recording head 32. An example of the suction pump 140 strokes a tube 144 in a direction indicated by an arrow C with a body of rotation 143 to generate a negative pressure on the inner side of the cap 141.

It is possible to move the cap 141 in an up-to-down direction (an arrow D direction in FIG. 3) with a driving mechanism 145. The driving mechanism 145 moves the cap 141 up and down with an electric actuator 146 such as a solenoid as a driving source. The rotation of a motor may be converted into a linear motion by a cam, a link mechanism, or the like to move the cap 141 up and down. In maintaining the recording head 32, the cap 141 is lifted to the recording head 32 to bring the cap 141 into close contact with the recording head 32. In this state, the suction pump 140 is actuated to suck an excess ink adhering to the nozzle section 32*a* of the recording head 32. The waste ink sucked is discharged into a waste ink tank 146. Thereafter, the cap 141 moves away from the recording head 32 and the nozzle section 32*a* of the recording head 32 is cleaned by the blade member 142.

On the other hand, the sheet guide 22 arranged below the recording head 32 to be opposed to the recording head 32 is provided to be freely inserted into and taken out from the apparatus body 11. As shown in FIG. 2, both sides of a bottom surface of the sheet guide 22 are slidably supported by guide rails 151. The guide rails 151 are disposed along a direction orthogonal to the conveying direction of the sheet, i.e., the moving direction of the recording head 32. The guide rails 151 can guide the sheet guide 22 along the moving direction of the recording head 32. A knob section 22*b* is provided at one end of the sheet guide 22. The sheet guide 22 is pulled out by grabbing the knob 22*b* with a hand. An opening 11*a* is formed on one side of the apparatus body 11 as shown in FIG. 1. The sheet guide 22 is inserted in and taken out from this opening 11*a*.

Figure 5:
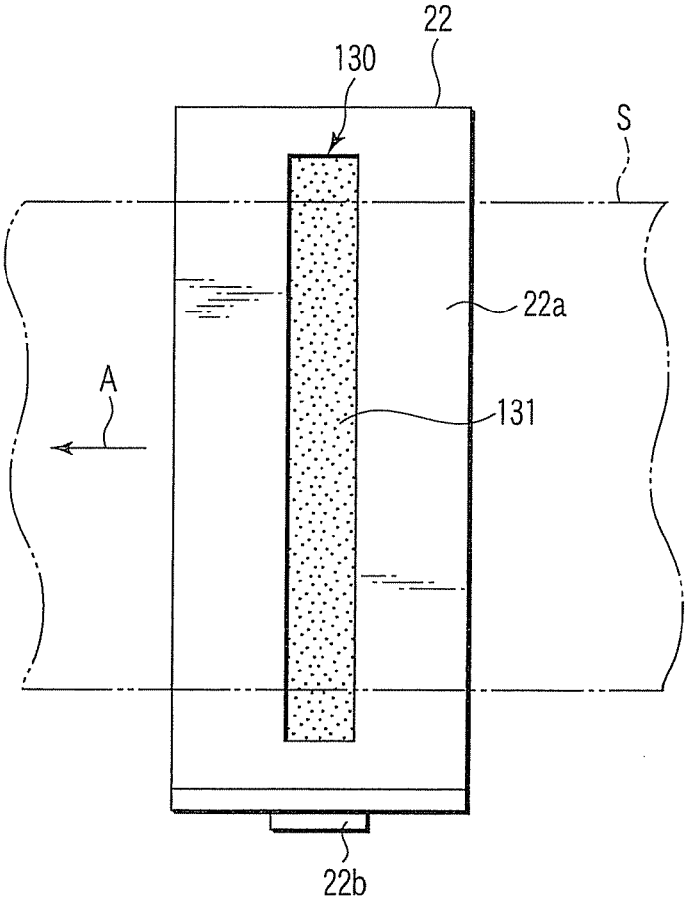
FIG. 5 is a plan view showing a sheet guide in FIG. 2.
Figure 6:
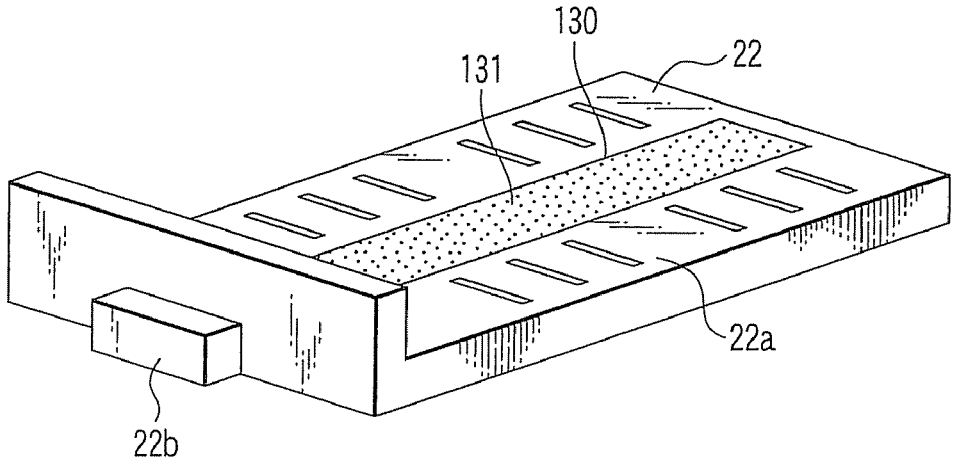
FIG. 6 is a perspective view showing the sheet guide in FIG. 2.

As shown in FIGS. 5 and 6, an ink absorbing section 130 is formed on the upper surface side of the sheet guide 22. The ink absorbing section 130 is opposed to the nozzle section 32*a* (shown in FIG. 2) of the recording head 32 and formed in a position lower than the guide surface 22*a*. The width of the ink absorbing section 130 is larger than the width of the sheet S. For example, a sponge-like ink absorbing member 131 is housed in this ink absorbing section 130. When rimless printing on a sheet is performed, an excess ink ejected on the outside of the edge of the sheet is absorbed by this ink absorbing member 131, whereby following sheets are prevented from being stained. The ink absorbing member 131 is provided detachably attachable. It is possible to remove the ink absorbing member 131 as shown in FIG. 8.

At the time of the printing operation, since the ink is ejected from the recording head 32 and ink mist is generated around the recording head 32, in particular, the sheet guide 22 is stained by the ink mist. When the sheet guide 22 is stained, following sheets are stained when the sheet passes through the sheet guide 22. Thus, it is necessary to periodically clean the sheet guide 22.

Figure 7:
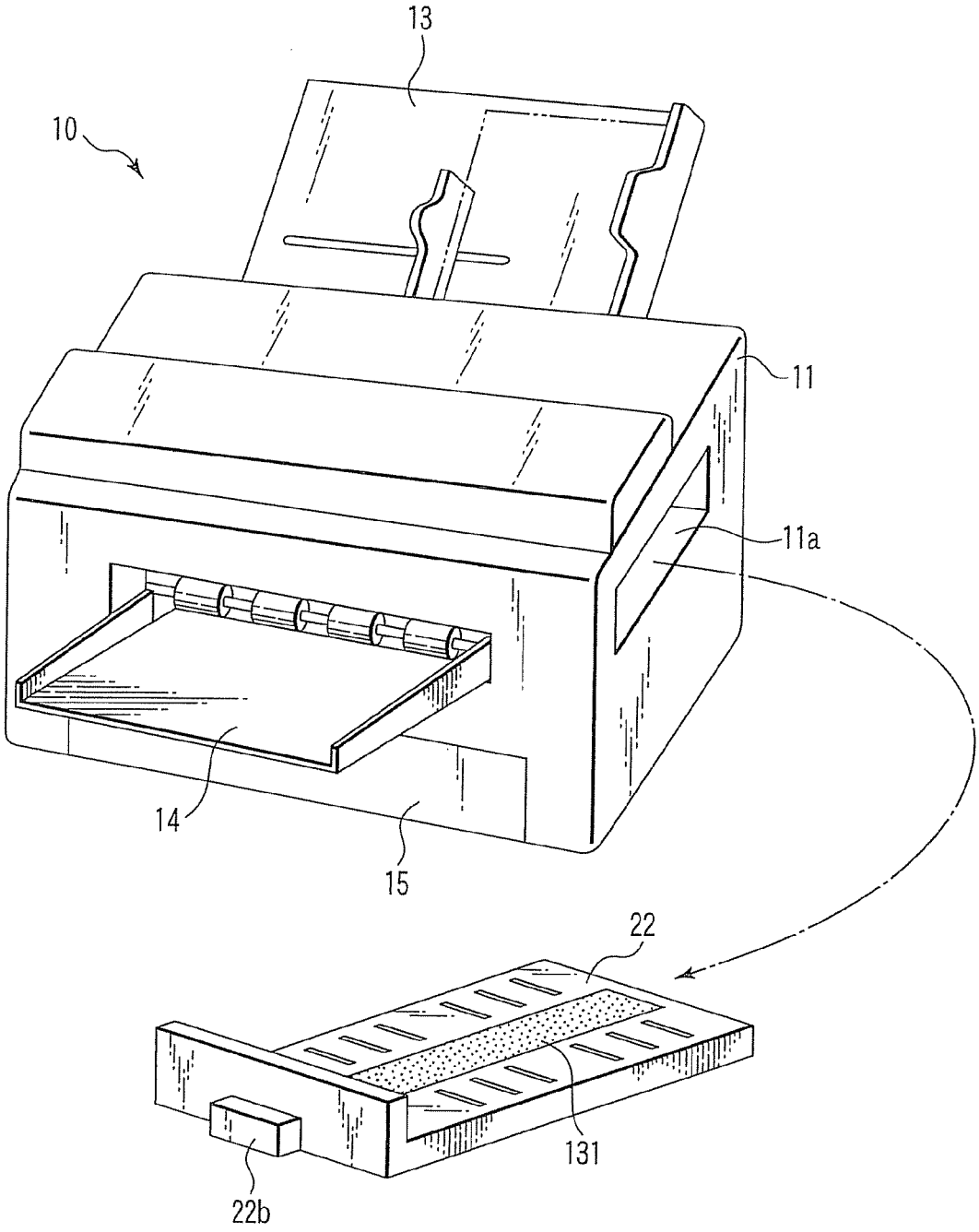
FIG. 7 is a perspective view showing a state in which the sheet guide in FIG. 2 is taken out from an apparatus body.

A method of cleaning the sheet guide 22 will be explained. In this case, first, a user inserts a hand into the opening 11*a* on one side of the apparatus body 11 and grabs the knob section 22*b* of the sheet guide 22 with the hand to pull the sheet guide 22 forward. Consequently, the user moves the sheet guide 22 forward along the guide rails 151 and, as shown in FIG. 7, takes out the sheet guide 22 to the outside from the opening 11*a* of the apparatus body 11. After taking out the sheet guide 22, the user performs cleaning of the sheet guide 22 and the ink absorbing member 131.

Figure 8:
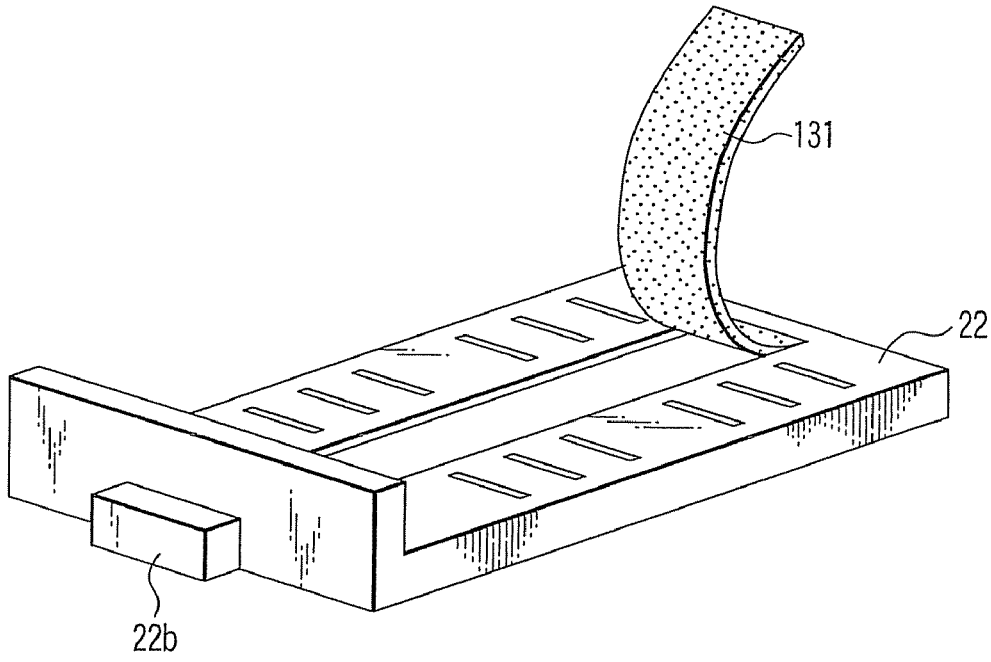
FIG. 8 is a perspective view showing a state in which an ink absorbing member is removed from the sheet guide in FIG. 7.

When it is necessary to replace the ink absorbing member 131, as shown in FIG. 8, the user removes the ink absorbing member 131 from the sheet guide 22 and attaches a new ink absorbing member to the sheet guide 22.

After cleaning the sheet guide 22 and the ink absorbing member 131 or replacing the ink absorbing member 131 in this way, the user inserts the sheet guide 22 from the opening 11*a* of the apparatus body 11 again and sets the sheet guide 22 in a predetermined position.

As described above, since it is possible to take out the sheet guide 22 to the outside of the apparatus body 11 and clean the sheet guide 22, cleaning work is easily performed.

Since it is also possible to perform cleaning and replacement work for the ink absorbing member 131 on the outside of the apparatus body 11, workability is high and it is possible to prevent the user from touching the ink absorbing member 131 and being smeared with the ink as much as possible.

Figure 9:
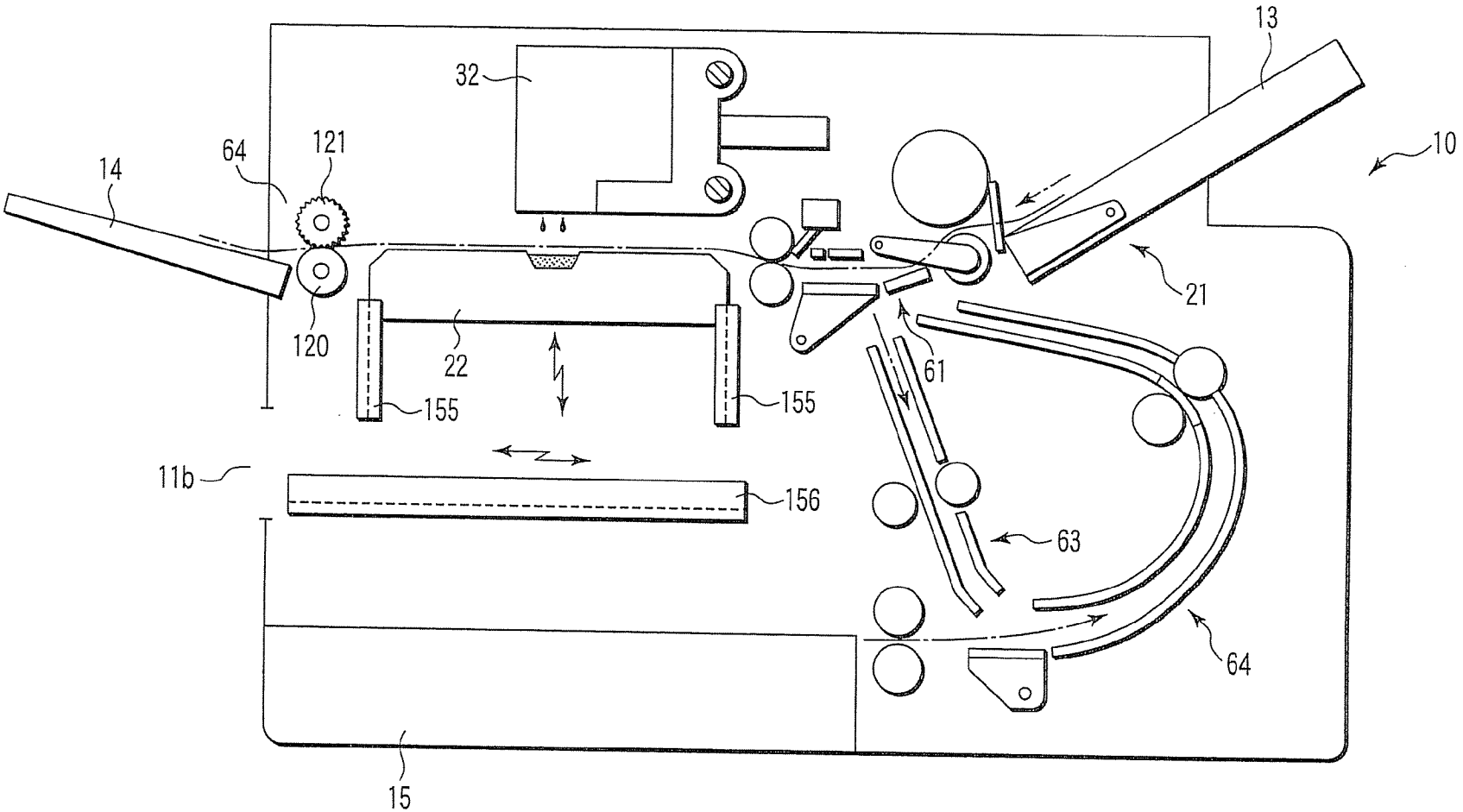
FIG. 9 is a diagram showing an image forming apparatus according to a second embodiment of the invention.

FIG. 9 shows a second embodiment of the invention.

In the first embodiment, the sheet guide 22 is inserted and taken out along the traveling direction of the recording head 32. However, in the second embodiment, the sheet guide 22 is inserted and taken out along a direction orthogonal to the traveling direction of the recording head 32, i.e., the conveying direction of a sheet.

In this second embodiment, when the sheet guide 22 is simply pulled out along the conveying direction of a sheet, it is likely that the sheet guide 22 comes into contact with the discharge roller 120 and scratches the discharge roller.

Thus, in this second embodiment, after the sheet guide 22 is once moved downward and away from the recording head 32, the sheet guide 22 is pulled out.

Vertical guide members 155 and a horizontal guide member 156 are disposed below the sheet guide 22. The sheet guide 22 is moved in the up-to-down direction along the vertical guide members 155 and moved in the horizontal direction along the horizontal guide member 156.

Figure 10:
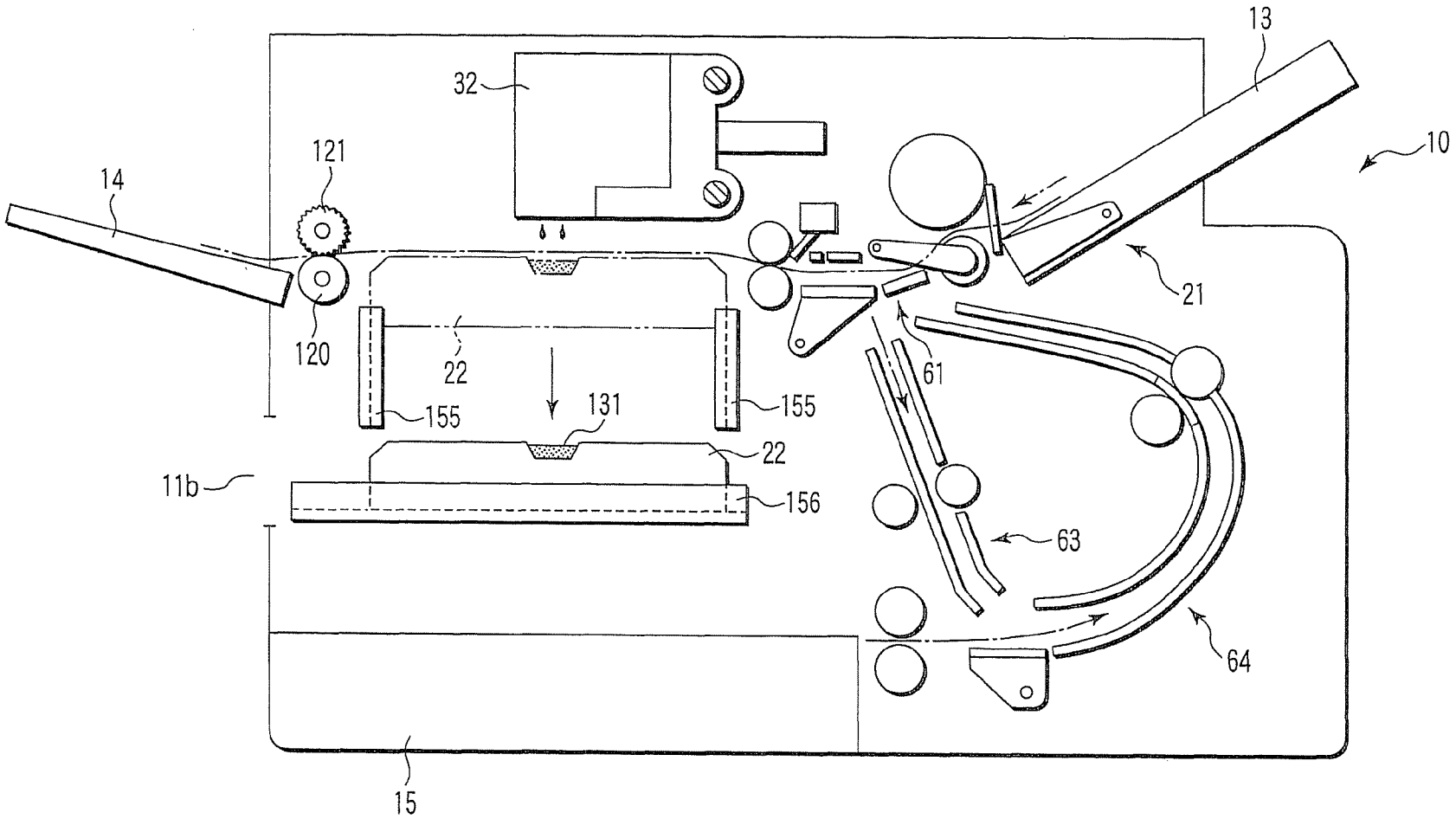
FIG. 10 is a diagram showing a state in which a sheet guide is taken out from the image forming apparatus in FIG. 9.
Figure 11:
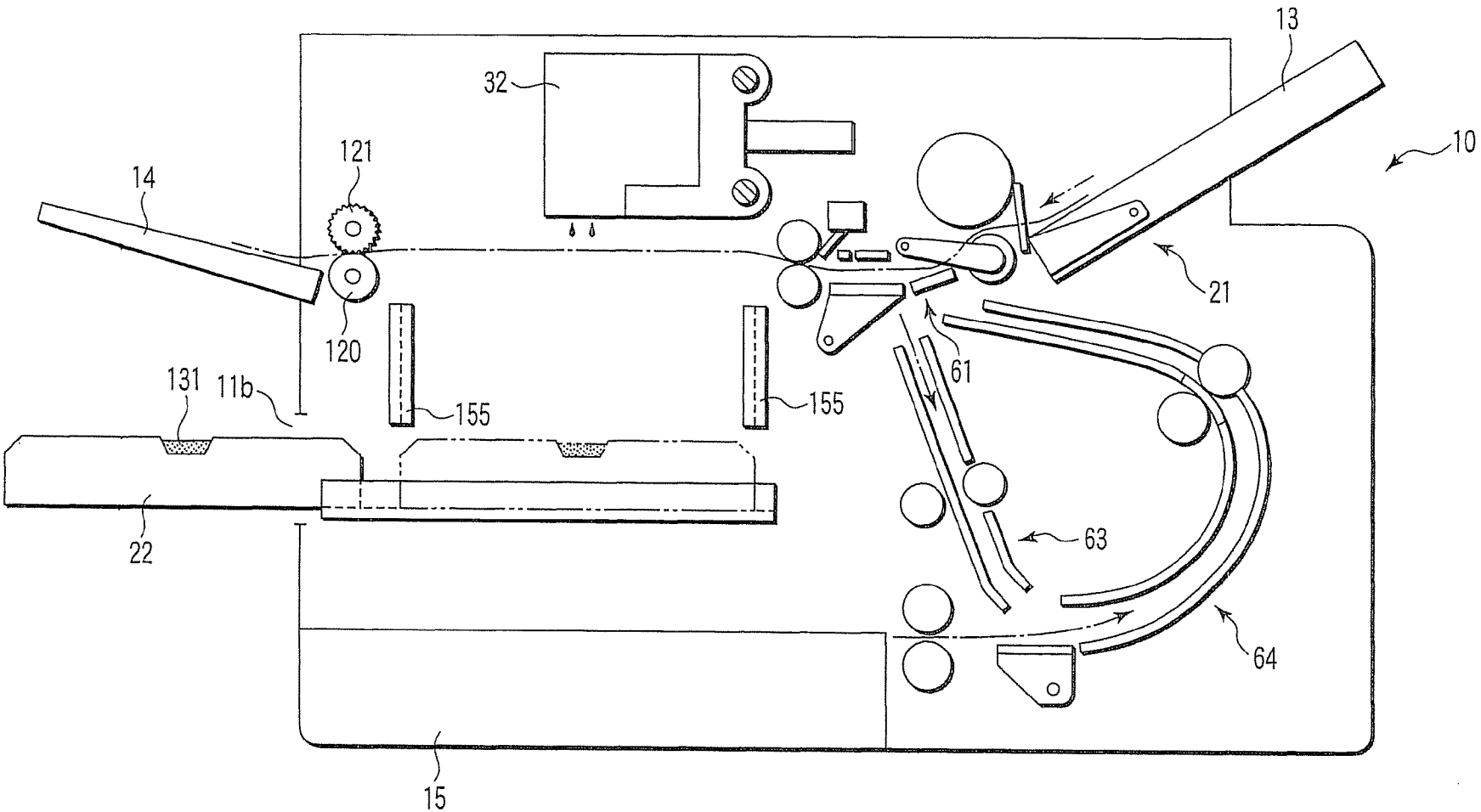
FIG. 11 is a diagram showing a state in which the sheet guide in FIG. 10 is taken out to the outside.

In cleaning the sheet guide 22, as shown in FIG. 10, a user once moves the sheet guide 22 downward along the vertical guide members 155 and places the sheet guide 22 on the horizontal guide member 156. Subsequently, the user inserts a hand from an opening 11*b* on the front side of the apparatus body 11 to take out the sheet guide 22 to the outside of the apparatus body 11 as shown in FIG. 11.

After taking out the sheet guide 22 in this way, the user cleans the sheet guide 22 and the ink absorbing member 131 as explained in the first embodiment. When it is necessary to replace the ink absorbing member 131, the user replaces the ink absorbing member 131.

According to this second embodiment, as in the first embodiment, it is easy to clean the sheet guide 22 and clean and replace the ink absorbing member 131.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a housing;

a conveying device that is provided in the housing and conveys a medium;

a recording device that ejects an ink to the medium conveyed by the conveying device and records an image on the medium; and a media guide that is spaced apart from and opposed to the recording device, has a knob, guides the medium, and is provided to be freely inserted into and taken out from the housing.

2. An image forming apparatus according to claim 1, comprising an ink absorbing member that is provided detachably attachable to the media guide and absorbs an ink ejected on an outside of the medium at the time of ejection of the ink to the medium.

3. An image forming apparatus according to claim 1, wherein the recording device moves in a direction orthogonal to a conveying direction of the medium.

4. An image forming apparatus according to claim 3, wherein the media guide is moved parallel to the moving direction of the recording device and taken out.

5. An image forming apparatus according to claim 3, wherein the media guide is once moved in a direction away from the recording device and then moved in a direction orthogonal to the moving direction of the recording device and taken out.

6. An image forming apparatus comprising:

a housing;

conveying means for conveying a medium, the conveying means being provided in the housing;

recording means for ejecting an ink to the medium conveyed by the conveying device and recording an image on the medium; and guide means for guiding the medium, the guide means being spaced apart from and opposed to the recording means, has a knob, and provided to be freely inserted into and taken out from the housing.

7. An image forming apparatus according to claim 6, comprising an ink absorbing member that is provided detachably attachable to the guide means and absorbs an ink ejected on an outside of the medium at the time of ejection of the ink to the medium.

8. An image forming apparatus according to claim 6, wherein the recording means moves in a direction orthogonal to the conveying direction of the medium.

9. An image forming apparatus according to claim 8, wherein the guide means is moved parallel to the moving direction of the recording means and taken out.

10. An image forming apparatus according to claim 8, wherein the guide means is once moved in a direction away from the recording means and then moved in a direction orthogonal to the moving direction of the recording means and taken out.

* * * * *